US008579216B2

(12) United States Patent
Fujita

(10) Patent No.: US 8,579,216 B2
(45) Date of Patent: Nov. 12, 2013

(54) INJECTION NOZZLE FOR REPAIRING A WALL ELEMENT

(75) Inventor: Shogo Fujita, Katsushika-ku (JP)

(73) Assignee: FS Technical Corporation, Tokyo (JP)

( * ) Notice: Subject to any disclaimer, the term of this patent is extended or adjusted under 35 U.S.C. 154(b) by 1022 days.

(21) Appl. No.: 11/989,547

(22) PCT Filed: Aug. 2, 2006

(86) PCT No.: PCT/JP2006/315700

§ 371 (c)(1),
(2), (4) Date: Jan. 28, 2008

(87) PCT Pub. No.: WO2007/018224

PCT Pub. Date: Feb. 15, 2007

(65) Prior Publication Data

US 2009/0313939 A1 Dec. 24, 2009

(30) Foreign Application Priority Data

Aug. 5, 2005 (JP) ..... 2005-228459

(51) Int. Cl.
*B05B 1/30* (2006.01)

(52) U.S. Cl.
USPC ..... 239/584; 239/271; 239/281; 141/260; 141/266

(58) Field of Classification Search
USPC ..... 239/225.1, 251, 252, 271, 284.1, 239/280–281, 584; 52/742.1, 742.13; 141/251, 258–260, 266, 275, 318, 374
See application file for complete search history.

(56) References Cited

U.S. PATENT DOCUMENTS 2,595,598 A * 5/1952 Morton ..... 239/204
4,967,931 A * 11/1990 DeVries ..... 222/1
5,062,486 A * 11/1991 McClenahan ..... 169/70

FOREIGN PATENT DOCUMENTS

| | | |
|---|---|---|
| DE | 100 64 619 A1 | 6/2002 |
| JP | A-07-238690 | 9/1995 |
| JP | A-2003-147971 | 5/2003 |
| JP | A-2004-238847 | 8/2004 |
| WO | WO 97/18367 A1 | 5/1997 |

* cited by examiner

*Primary Examiner* — Jason Boeckmann
(74) *Attorney, Agent, or Firm* — Oliff & Berridge, PLC

(57) ABSTRACT

A connection arm (31) of an injection nozzle (22) has an adhesive passage (36). A nozzle outer cylinder (32) is supported by the connection arm (31) and has an intermediate passage (48) in communication with the adhesive passage (36) and a sealing member (44). A nozzle inner cylinder (33) is elongated through the sealing member (44), is slidably supported inside the nozzle outer cylinder (32), and has a communication opening (64) communicating with the intermediate passage (48) as well as an adhesive discharge port (63). An operation member (34) moves the nozzle inner cylinder (33) between an advanced position where the adhesive discharge port (63) lies deep inside a charging hole (8) and a receded position where the adhesive discharge port (63) lies shallow inside the charging hole (8) bored into a framework (2) to a predetermined depth through a finishing material (3).

8 Claims, 9 Drawing Sheets

INJECTION NOZZLE FOR REPAIRING A WALL ELEMENT

TECHNICAL FIELD

This invention relates to an injection nozzle for use in a pinning method which is employed in repairing a wall element such as an outer wall or an inner wall in which the so-called "separation" has occurred, and also relates to a pinning method using the injection nozzle.

BACKGROUND ART

As a conventional injection nozzle, there is known one made up of an inner cylinder which is shaped like a syringe needle having formed a discharge port at a front end thereof, and an outer cylinder which slidably supports the inner cylinder around its inner circumference, and the inside of which serves as a passage for an adhesive. The inner cylinder advances relative to the outer cylinder upon receiving an injection pressure of the adhesive (see JP-A 2003-147971). In a pinning method using this injection nozzle, after boring a charging hole into a portion requiring repairs on an outer wall which is made up of a finishing material (tile, stone, and the like), mortar, and concrete framework, injection of the adhesive (epoxy resin adhesive) is performed by using a resin injector (i.e., an injector for injecting a resin) having the injection nozzle mounted thereon. Specifically, the injection nozzle is held while urged against an opening portion of the charging hole, and the resin injector is pumped. Then, the inner cylinder advances first upon receipt of a charging force by the adhesive, and a discharge port of the inner cylinder reaches the bottom of the charging hole. Thereafter, the adhesive starts being discharged out of the discharge port, whereby the adhesive is gradually filled from the deepest portion of the charging hole.

With this kind of conventional injection nozzle, it is possible to fill the charging hole with the adhesive starting with the deepest portion thereof. Therefore, there is no possibility that air accumulation or the like occurs in the deepest portion of the charging hole. However, if the clearance (so-called "separated portion") between the mortar and the concrete framework is large, the adhesive is likely to flow into the clearance, thereby resulting in a possibility that the adhesive does not reach a shallow position of the charging hole. Particularly, in case there has also occurred a "separated portion" between the finishing material and the mortar, it is not possible with the above-described method to sufficiently fill the "separated portion" with the adhesive. As a solution, it becomes necessary to perform the injection work while pulling out the injection nozzle down to the "separated portion." In this case, however, since the sealing of the opening portion of the charging hole is released, it becomes impossible to sufficiently inject the adhesive into this kind of portion.

DISCLOSURE OF INVENTION

This invention has an object of providing an injection nozzle which is capable of sufficiently injecting an adhesive into a range covering from a deep portion to a shallow portion of a charging hole, as well as a pinning method using the same.

According to this invention, there is provided an injection nozzle for use in a pinning method, the injection nozzle being adapted to be mounted on an injector main body while in use, the pinning method being performed by injecting an adhesive into a charging hole bored into a framework to a predetermined depth through a finishing material, the injection of the adhesive being made while sealing an opening portion of the charging hose. The injection nozzle comprises: a connection arm mounted on the injector main body and having an adhesive passage in communication with the injector main body; a nozzle outer cylinder supported by the connection arm and having therein an intermediate passage in communication with the adhesive passage, the nozzle outer cylinder also having at a front end thereof a sealing member for sealing the opening portion; a nozzle inner cylinder elongating through the sealing member and being slidably supported inside the nozzle outer cylinder, the nozzle inner cylinder having formed, at a rear end thereof, a communication opening communicating with the intermediate passage and, at a front end thereof, an adhesive discharge port; and an operation member capable of moving the nozzle inner cylinder between an advanced position where the adhesive discharge port lies deep inside the charging hole and a receded position where the adhesive discharge port lies shallow inside the charging hole.

According to this configuration, when the adhesive is pumped out of the injector main body in a state in which the opening portion of the charging hole is sealed by the sealing member of the nozzle outer cylinder, the adhesive flows into the intermediate passage of the nozzle outer cylinder through the adhesive passage in the connection arm and further flows from the communication opening of the nozzle inner cylinder to the adhesive discharge port. From this adhesive discharge port, the adhesive is injected into the charging hole. At this time, if the nozzle inner cylinder has been moved to the advanced position by the operation member, the adhesive is injected into the deep portion of the charging hole and, if it has been moved to the receded position, the adhesive is injected into the shallow portion of the charging hole. This injection into the deep portion and the shallow portion of the charging hole can be performed in a state in which the opening portion of the charging hole is kept sealed. Therefore, the adhesive can be sufficiently spread also into the "separated portion."

In this case, it is preferable that the operation member be connected to the rear end of the nozzle inner cylinder and constituted of a rod-shaped member elongating through the rear end of the nozzle outer cylinder.

According to this configuration, the nozzle inner cylinder can be operated by the operation member so as to be pushed and pulled from the rear end, and the back and forth movement of the nozzle inner cylinder can easily and surely be performed.

In this case, it is preferable that the nozzle inner cylinder and the operation member be constituted of an integral pipe having formed the penetrating hole through a peripheral wall thereof.

According to this configuration, the nozzle inner cylinder and the operation member can be made simple in construction, and they can be manufactured easily.

It is preferable that the operation member, on the other hand, be formed to have a diameter larger than that of the nozzle inner cylinder.

According to this configuration, when the injection of the adhesive is started from the deep portion of the charging hole in a state in which the nozzle inner cylinder is advanced by the operation member, the internal pressure in the intermediate passage increases with the progress of the injection. When the internal pressure in the intermediate passage increases, this internal pressure acts strongly on the large-diameter operation member and, as a result, the nozzle inner cylinder gradually recedes by means of the operation member. In other words, without manipulating the operation member to recede, the nozzle inner cylinder can recede automatically. In this manner, the adhesive can be sufficiently injected over a range from the deep portion to the shallow portion of the charging hole. The balance between the internal pressure in the intermediate passage and the timing to start the receding of the nozzle internal cylinder shall preferably be adjusted by the diameter of the operation member, the sliding resistance of the operation member against the nozzle outer cylinder, or the combination of this sliding resistance and the sliding resistance of the nozzle inner cylinder against the sealing member.

In these cases, it is preferable that the injection nozzle further comprise at a front end of the nozzle inner cylinder a pressure-receiving flange for receiving a discharge pressure of the adhesive injected from the adhesive discharge port into the charging hole.

According to this configuration, when the injection of the adhesive is started frog the deep portion of the charging hole, in a state in which the nozzle cylinder is advanced by the operation member, the adhesive injected into the charging hole pushes the pressure-receiving flange, whereby the nozzle inner cylinder recedes. As a result, the nozzle inner cylinder can automatically recede to a position at which the discharge pressure (injection pressure) of the adhesive is relieved into the separated portion in the finishing material, and the like. It is preferable that the balance between the discharge pressure of the adhesive and the timing to start the receding of the nozzle inner cylinder be adjusted by the sliding resistance of the nozzle inner cylinder against the sealing member, and the like.

In these cases, it is preferable that the nozzle inner cylinder have a reinforcing member for reinforcing the portion which forms the communication opening and that the reinforcing member serves as a stopper for restricting the receded position of the nozzle inner cylinder.

According to this configuration, it is possible not only to reinforce the portion forming the communication opening in the nozzle inner cylinder but also to prevent the nozzle inner cylinder from getting out of position into the nozzle outer cylinder.

In these cases, it is preferable that the nozzle outer cylinder comprise: an outer cylinder main body of cylindrical shape; a front-end closing cap for closing the front end of the outer cylinder main body; and a rear-end closing cap for closing the rear end of the outer cylinder main body, and that the front-end closing cap is coupled to the outer cylinder main body in a state of sandwiching a base portion of the sealing member between the cap and the outer cylinder main body.

According to this configuration, it is possible to simply perform the assembling of the sealing member into the outer cylinder main body and the closing of the front end of the outer cylinder main body. In addition, by making use of the sealing member, the front end of the outer cylinder main body can be sealed in a liquid-tight state.

On the other hand, it is preferable that the rear-end portion of the nozzle inner cylinder be provided with a piston portion which comes into sliding contact with an inner circumference of the nozzle outer cylinder.

According to this configuration, when the injection of the adhesive is started from the deep portion of the charging hole in a state in which the nozzle inner cylinder is advanced by the operation member, the internal pressure in the intermediate passage increases with the progress of the injection. When the internal pressure in the intermediate passage increases, this internal pressure acts on the piston portion, whereby the nozzle inner cylinder gradually recedes by means of the piston portion. In other words, since the nozzle inner cylinder can be automatically caused to recede without operating the operation member to recede, the adhesive is sufficiently injected into the charging hole over a range from the deep portion to the shallow portion thereof. The balance between the internal pressure in the intermediate passage and the timing to start the receding of the nozzle inner cylinder shall preferably be adjusted by the sliding resistance of the piston portion against the nozzle outer cylinder, or the combination of this sliding resistance and the sliding resistance of the nozzle inner cylinder against the sealing member.

According to another aspect of this invention, there is provided a pinning method for repairing a wall member made up of a framework and a finishing material, the method being performed by using an adhesive injector made up of the injection nozzle and the injector main body having the injection nozzle mounted thereon according to claim 1. The method comprises the steps of: boring a charging hole by penetrating through the finishing material into a predetermined depth of the framework; injecting with the adhesive injector the adhesive into the charging hole while sealing an opening portion of the charging hole; and charging the charging hole with an anchor pin which anchors the finishing material to the framework, the charging hole having been injected with the adhesive.

According to this configuration, by operating the operation member to cause the nozzle inner cylinder to advance or recede, the adhesive can be injected uniformly to a range from the deep portion to the shallow portion of the charging hole. Therefore, repairing of the framework can be performed well.

As described above, according to the injection nozzle and the pinning method of this invention, even if the "separated portion" of the finishing material relative to the framework is present at a plurality of points in the depth direction of the charging hole, or even if the positions vary from one another, the injection of the adhesive into the charging hole can be performed adequately and sufficiently by operating the nozzle inner cylinder to advance or recede. As a result, a complete repairing of the wall member where the "separated portions" have occurred can be made.

BEST MODE FOR CARRYING OUT THE INVENTION

With reference to the accompanying drawings, a description will now be made about an injection nozzle and a pinning method using the same relating to an embodiment of this invention. In this pinning method, an injection nozzle of an adhesive injector is inserted into a charging hole from its opening portion, which is bored into that portion to be repaired of an outer wall of a building structure, an inner wall (wall element) of stairwell, a hall, and the like, at which a "separation" has occurred. An adhesive is then injected into the charging hole and, thereafter, the charging hole is charged with an anchor pin, thereby repairing the separation. A description will now be made about an example in which this repairing is made on an outer wall of a building structure.

Figure 1:
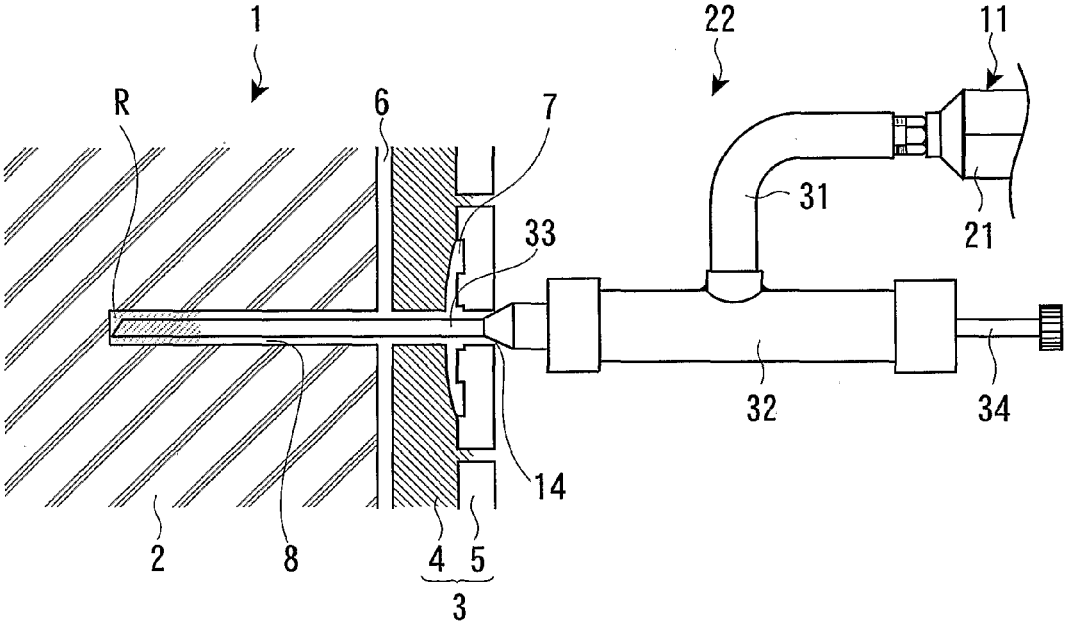
FIG. 1 is a sectional schematic view showing a state in which an adhesive injector relating to an embodiment of this invention is used for a charging hole of an outer wall.

FIG. 1 is a schematic view of a case in which the adhesive injector is used for an outer wall. As shown in FIG. 1, the outer wall 1 of a building or a structure is made up, as seen from the left side of the Figure, of a concrete framework 2 which serves as a base, and a finishing material 3 which is coated on the surface thereof. The finishing material 3 includes mortar 4 and a decorative material 5, such as tile and stone which is adhered to the mortar 4. It is presumed that the space between the concrete framework 2 and the mortar 4 gives a first separated portion 6, and that the space between the mortar 4 and the decorative material 5 gives a second separated portion 7. For the purpose of repairing them, the outer wall 1 has formed therein a charging hole 8 which is penetrated through the decorative material 5 and the mortar 4 and bored to a predetermined depth of the concrete framework 2. By injecting into the charging hole 8 an adhesive R with an adhesive injector 11 and by charging the charging hole 8 with an anchor pin 70 (see FIGS. 5A to 5C and 6A to 6C), the repairing of the outer wall 1 is performed. The term "finishing material" in claims shall be understood to have been generically used and is therefore construed to refer to only the mortar 4 as a minimum requirement; the decorative material 5 shall or shall not be included on a case by case basis.

Figure 2:
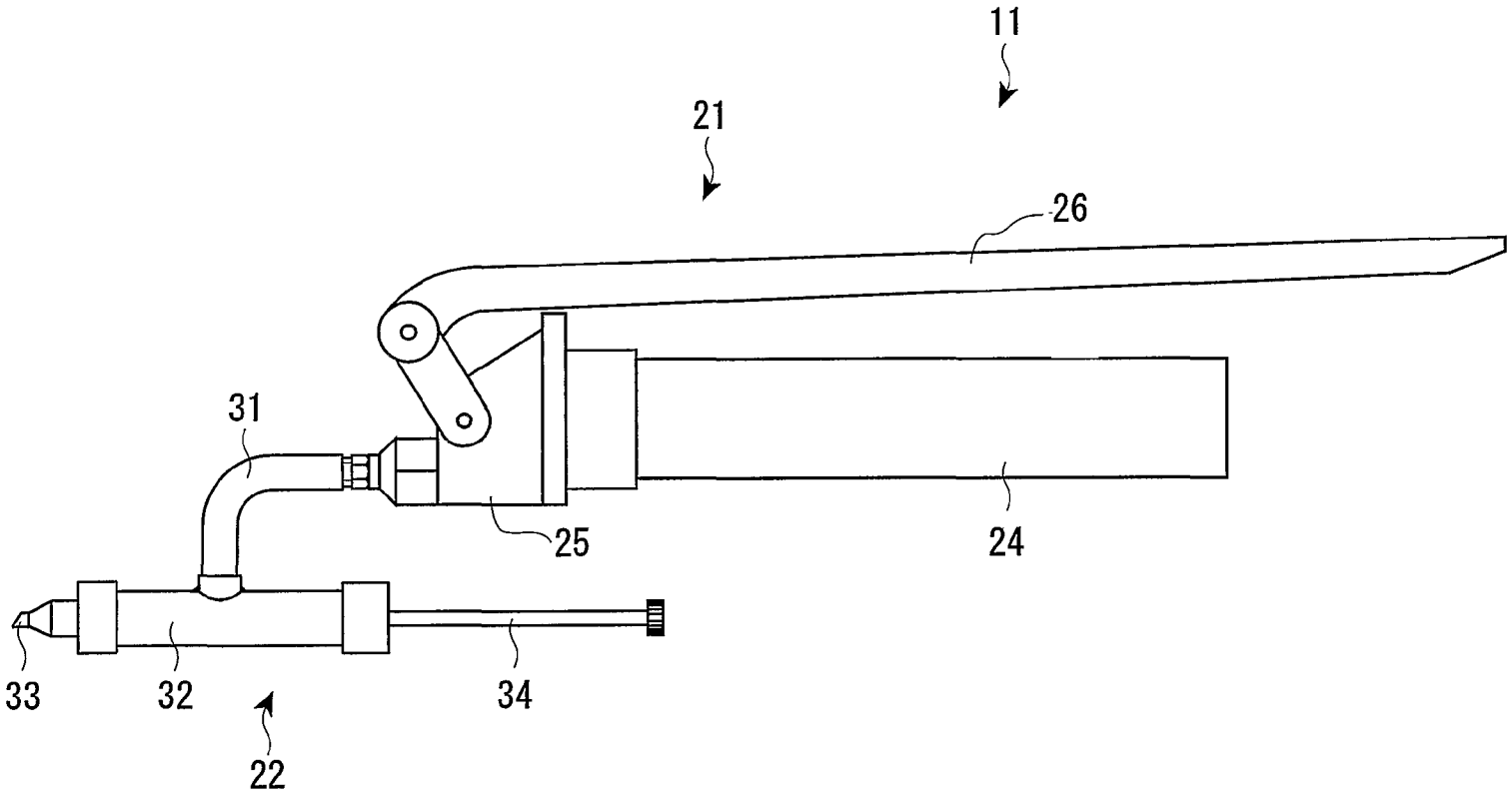
FIG. 2 is a plan view of the adhesive injector.

With reference to FIG. 2, a description will be made about the adhesive injector 11. The adhesive injector 11 is made up of: an injector main body 21 which forms the main part and is of a pump type to supply the adhesive R; and an injection nozzle 22, for use in the pinning method, the injection nozzle 22 being detachably mounted on a front end portion of the injector main body 21.

The injector main body 21 is made up of: a cylindrical casing 24 which extends to the base end side; a pump main body 25 on which is detachably mounted the casing 24; and a substantially L-shaped lever 26 which is held by the pump main body 25. The casing 24 has the adhesive R filled therein. The pump main body 25 has set thereto the casing 24 from the right side as seen in the figure and has mounted thereon the injection nozzle 22 from the left side as seen in the figure. The injector main body 21 is thus arranged to discharge the adhesive R from the injection nozzle 22 by a certain amount at a time through the manual operation (pumping) of the lever 26. As the adhesive R, an epoxy resin adhesive is used. Instead of limiting to the above, an inorganic adhesive having viscosity as well as various kinds of organic adhesives may be used.

Figure 3:
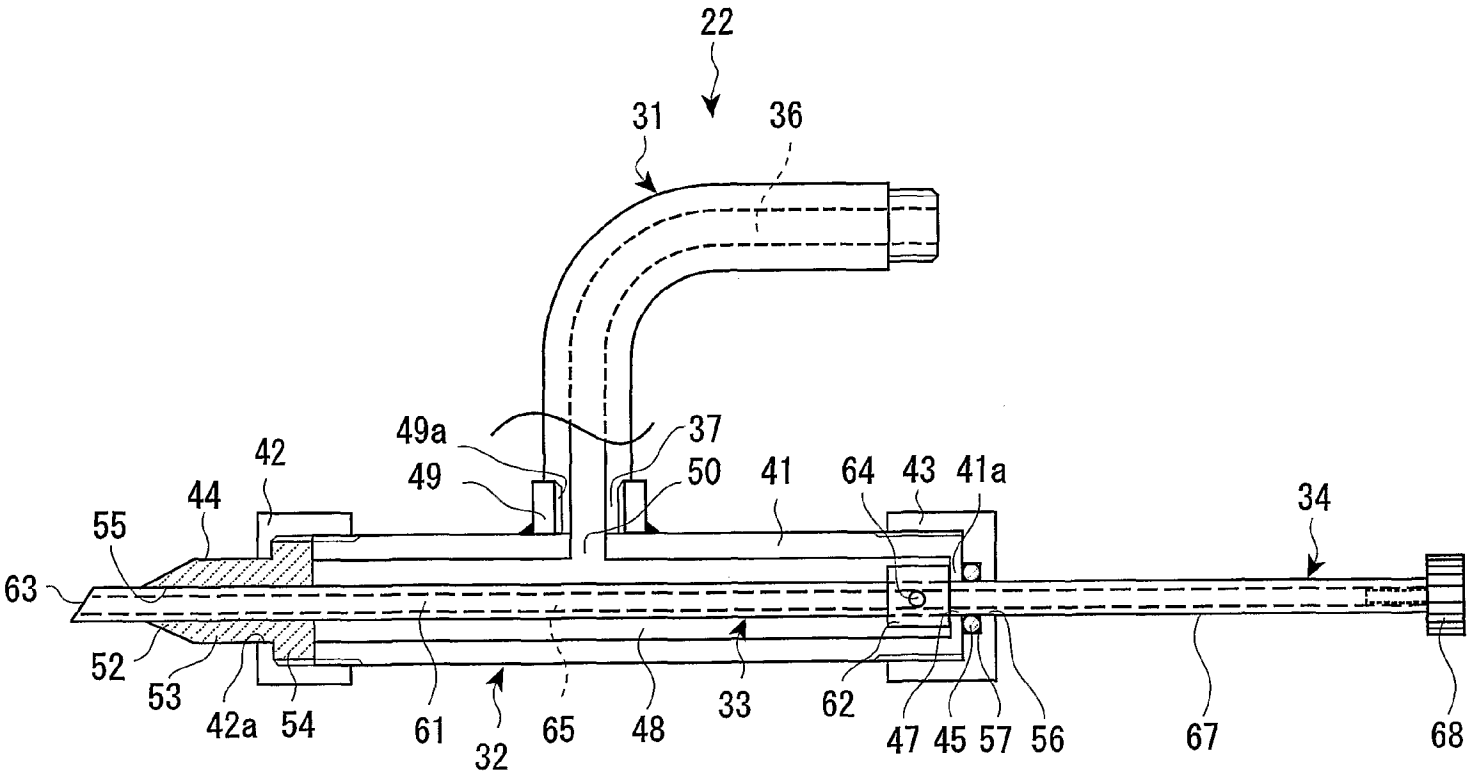
FIG. 3 is a sectional view of an injection nozzle relating to the first embodiment of this invention.

As shown in FIGS. 1 and 3, the injection nozzle 22 is made up of: a connection arm 31 one end portion of which is detachably mounted on the injector main body 21 and the whole of which is formed into an "L" shape; a cylindrical nozzle outer cylinder 32 which is supported by the connection arm 31; a syringe-like nozzle inner cylinder 33 which is supported inside the nozzle outer cylinder 32 so as to be movable back and forth; and an operation rod (operation member) 34 which is in communication with the rear end of the nozzle inner cylinder 33 so as to move the nozzle inner cylinder 33 back and forth. The adhesive R pumped out of the injector main body 21 by pumping flows through the connection arm 31 into the inside of the nozzle outer cylinder 32, and is discharged from the inside of the nozzle outer cylinder 32 through the inside of the nozzle inner cylinder 33 out of the front end thereof. The nozzle inner cylinder 33 is moved back and forth by the operation rod 34 to suit the depth of the charging hole 8.

The connection arm 31 is constituted of an elbow-shaped pipe of stainless steel or steel, having therein an adhesive passage 36 which is in communication with the injector main body 21, and has formed male threads 37 and 37 on both end portions thereof. The connection arm 31 is formed strong enough to transmit the urging force to urge the front end of the nozzle outer cylinder 32 to the opening portion 14 of the charging hole 8. Its length is adjusted so as to be located in a position such that the nozzle outer cylinder 32 and the operation rod 34 do not hinder the pumping of the injector main body 21 (see FIG. 2). The connection arm 31 may be made of a pipe with a rib in consideration of the mechanical strength or may simply be a hollow (serving as an adhesive passage 36) member. Namely, the connection arm 31 may be constituted of a pipe having the adhesive passage 36 and an arm member having the pipe attached thereto.

The nozzle outer cylinder 32 is made up of: an outer cylinder main body 41 of a cylindrical shape; a front-end closing cap 42 for closing the front end of the outer cylinder main body 41; a rear-end closing cap 43 for closing the rear end of the outer cylinder main body 41; a sealing member 44 disposed so as, to project from the front-end closing cap 42; and an O-ring 45 mounted in position on the inner side of the rear-end closing cap 43. The outer cylinder main body 41 is formed into a cylindrical shape having the bottom on the rear-end side. A bottomed portion 41*a* has formed therein a penetrating hole 47 through which the operation rod 34 penetrates and has constituted therein an intermediate passage 48 which is in communication with the adhesive passage 36. Further, at the intermediate position as seen in the fore-and-aft direction of the outer cylinder main body 41, there is provided in a projecting manner a boss portion 49 having a female thread 49*a*. One end of the connection arm 31 is connected in a threaded manner to this boss portion 49. The boss portion 49 has formed therein a passage opening 50 communicating together the intermediate passage 48 formed inside the outer cylinder main body 41 and the adhesive passage 36 in the connection arm 31.

The sealing member 44 is constituted of a solvent-resistant elastic material such as fluororubber or butyl rubber, and is integrally made up of: a tapered portion 52 for sealing the opening portion 14 of the charging hole 8; a cylindrical body portion 53 which extends rearward of the tapered portion 52; and a flange portion 54 which extends rearward of the cylindrical body portion 53. The flange portion 54 is formed to have the same diameter as the inside diameter of the front-end closing cap 42 (outside diameter of the outer cylinder main body 41). The cylindrical body portion 53 is formed to have the same diameter as a circular opening 42*a* of the front-end closing cap 42. Along the axis of the sealing member 44, there is formed an inserting hole 55 through which the nozzle inner cylinder 33 slidably moves in a liquid-tight state. On the other hand, the front-end closing cap 42 has the circular opening 42*a* through which the cylindrical body portion 53 of the sealing member 44 moves, and is engaged in a threaded manner with the peripheral surface on the front side of the outer cylinder main body 41 in a state in which the flange portion 54 of the sealing member 44 is housed on an inner side thereof. In this state, the flange portion 54 is strongly held between the front-end closing cap 42 and the end surface of the outer cylinder main body 41, whereby the clearance between the outer cylinder main body 41 and the front-end closing cap 42 is sealed.

The rear-end closing cap 43 has a rod-inserting hole 56 which is in communication with the penetrating hole 47 of the outer cylinder main body 41, and an annular groove 57 which faces the rod-inserting hole 56. The O-ring 45 is mounted in the annular groove 57. The rear-end closing cap 43 is engaged in a threaded manner with the peripheral surface of the rear-end portion of the outer cylinder main body 41 with the operation rod 34 inserted therein. In this state, the O-ring 45 is strongly held between the rear-end closing cap 43 and the bottomed portion 41*a* of the outer cylinder main body 41, and also comes into sliding contact with the operation rod 34. The clearance among the outer cylinder main body 41, the rear-end closing cap 43, and the O-ring 45 is sealed from one another.

On the other hand, the nozzle inner cylinder 33 is made up of: an inner cylinder main body 61 which is formed into a shape like a straight syringe; and a stopper block (reinforcing member) 62 which is fixed by fitting to the rear-end portion of the inner cylinder main body 61. The nozzle inner cylinder 33 is supported in a manner slidable back and forth by the sealing member 44 on the front-end side and by the O-ring 45 through the operation rod 34 on the rear-end side, respectively. The inner cylinder main body 61 is made of a metallic pipe such as stainless steel or a resin pipe, and the stopper block 62 is made of a resin, and the like. At the front-end portion of the nozzle inner cylinder 33, there is formed a diagonally-cut adhesive discharge port 63. At the rear-end portion thereof, a pair of communication openings 64 and 64 (only one of them shown) are oppositely formed so as to pass through the peripheral surfaces of the stopper block 62 and the inner cylinder main body 61. The stopper block 62 serves as a reinforcing member of the inner cylinder main body 61 having the pair of communication openings 64 and 64 formed therein. The inside of the inner cylinder main body 61 serves as an injection passage 65 of the adhesive R. The adhesive R inside the intermediate passage 48 of the nozzle outer cylinder 32 flows from the pair of the communication openings 64 and 64 along the injection passage 65 and is injected out of the adhesive discharge port 63 into the charging hole 8. The communication openings 64 may be one or three or more in number, and they shall preferably be circular or elliptic in shape.

The inner cylinder main body 61 is constituted so as to be movable (slidable) between an advanced position at which the stopper block 62 is in abutment with the sealing member 44, and a receded position at which the stopper block 62 is in abutment with the bottomed portion 41*a* of the outer cylinder main body 41. The length of the inner cylinder main body 61 is so designed that, at the advanced position of the nozzle inner cylinder 33, the adhesive discharge port 63 reaches the bottom of the charging hole 8 and that, at the receded position of the nozzle inner cylinder 33, the adhesive discharge port 63 slightly protrudes beyond the sealing member 44. In concrete, in order to cope with the conceivable deepest charging hole 8, the protruding dimension of the inner cylinder main body 61 beyond the sealing member 44 at the advanced position is designed to be about 100 mm. The inside diameter of the nozzle inner cylinder 33 (inner cylinder main body 61) is formed to be, e.g., 2 to 4 mm.

The operation rod 34 is made up of a rod main body 67 and an operation knob 68 which is detachably mounted on the rear-end portion of the rod main body 67. The operation rod 34 is connected to the rear-end portion of the nozzle inner cylinder 33. Actually, the inner cylinder main body 61 of the nozzle inner cylinder 33 and the rod main body 67 of the operation rod 34 are constituted of an integral pipe, and the inside thereof can be easily cleaned by taking the operation knob 68 out of position after use. During use, there is no possibility that the adhesive R flowing from the communication openings 64 goes around to the side of the operation rod 34 because the rear end of the rod main body 67 is sealed (threaded connection) by the operation knob 68. When the operation rod 34 is operated to move forward and backward by holding the operation knob 68, the nozzle inner cylinder 33 which is connected thereto is moved back and forth between the advanced position and the receded position.

At the time of beginning the injection operation, for example, the nozzle inner cylinder 33 is moved to the advanced position and the nozzle inner cylinder 33 is pushed into the charging hole 8 such that the sealing member 44 comes into contact with the opening portion 14. Then, the adhesive discharge port 63 comes into contact with the bottom of the charging hole 8, whereby the adjustment of the length of the nozzle inner cylinder 33 is finished. When the injection (pumping) of the adhesive R is started in this state, the adhesive R is gradually filled from the deepest portion of the charging hole 8. The adhesive R then reaches the first separated portion 6 between the concrete framework 2 and the mortar 4, and is thereby injected thereinto so as to spread over the first separated portion 6. When it is determined that the first separated portion 6 is so large that the adhesive R fails to be injected into the second separated portion 7 between the mortar 4 and the decorative material 5, the nozzle inner cylinder 33 recedes so that the adhesive discharge port 63 lies close to the position of the second separated portion 7, thereby continuing further injection. As a result, the adhesive R is injected so as to spread over the second separated portion 7.

Figure 4A:
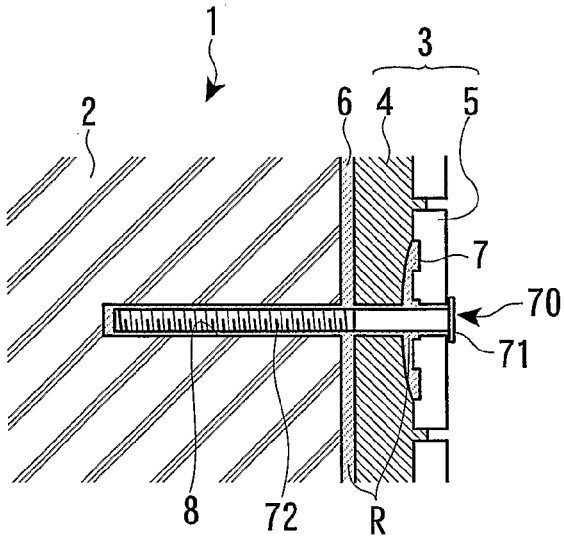
FIGS. 4A to 4C are front views of an anchor pin charged into a charging hole.
Figure 4B:
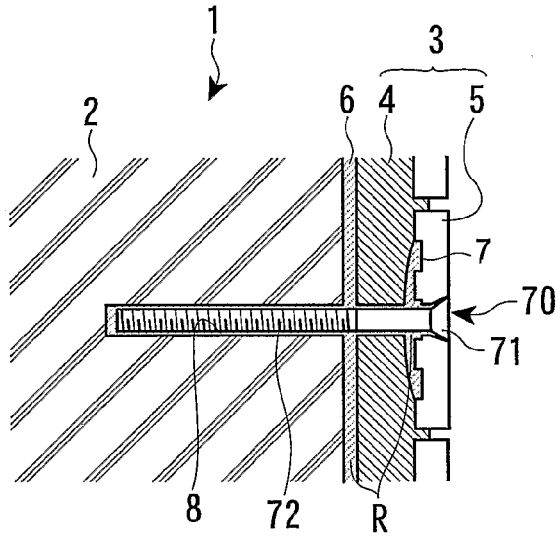
Figure 4C:
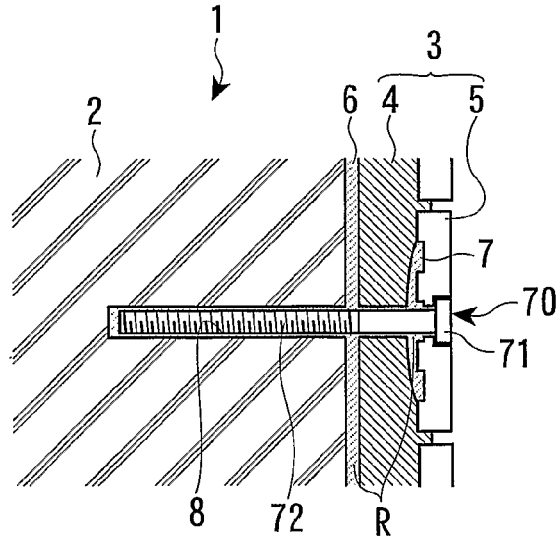

Next, with reference to FIGS. 4A to 4C, a description will be made about the anchor pin 70. The anchor pin 70 is made of stainless steel, and the like, and is made up of: a disc-shaped pin head portion 71 which is formed to have a diameter larger than that of the opening portion 14 of the charging hole 8 and to have a small thickness (0.3 mm to 0.5 mm); and a bar-shaped pin body portion 72 which is integrally formed with the pin head portion 71 and has a diameter slightly smaller than the diameter of the charging hole 8 (see FIG. 4A). The anchor pin 70 charged into the charging hole 8 will be such that the pin head portion 71 comes into contact with the opening edge portion of the charging hole 8, i.e., the surface of the decorative material 5, and that the pin body portion 72 reaches the deepest portion of the charging hole 8. In order to increase the pull-resistance strength, the pin body portion 72 is screwed on the peripheral surface thereof with a male thread, thereby constituting a fully-threaded pin. Further, the pin head portion 71 is colored by baking, and the like, so as to suit the coloration of the finishing material 3. The pin head portion 71 may alternatively be formed into a countersunk head (see FIG. 4B). In this case, there must be added, to the steps of the pinning method, an additional step of chamfering the opening portion 14 of the charging hole 8 to suit the pin head portion 71. Similarly, the pin head portion 71 may also be formed into a flat fillister head to correspond to the diameter of the countersunk boring (see FIG. 4C). In this case, there must be added, to the steps of the pinning method, an additional step of forming a countersunk bore at the opening portion 14 of the charging hole 8.

Figure 5A:
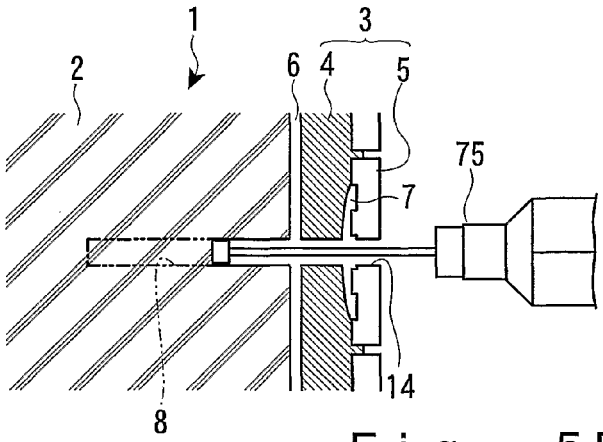
FIGS. 5A to 5C are procedural diagrams showing a boring step in the pinning method relating to this invention, a first step of injecting an adhesive, and a second step thereof, respectively.
Figure 5B:
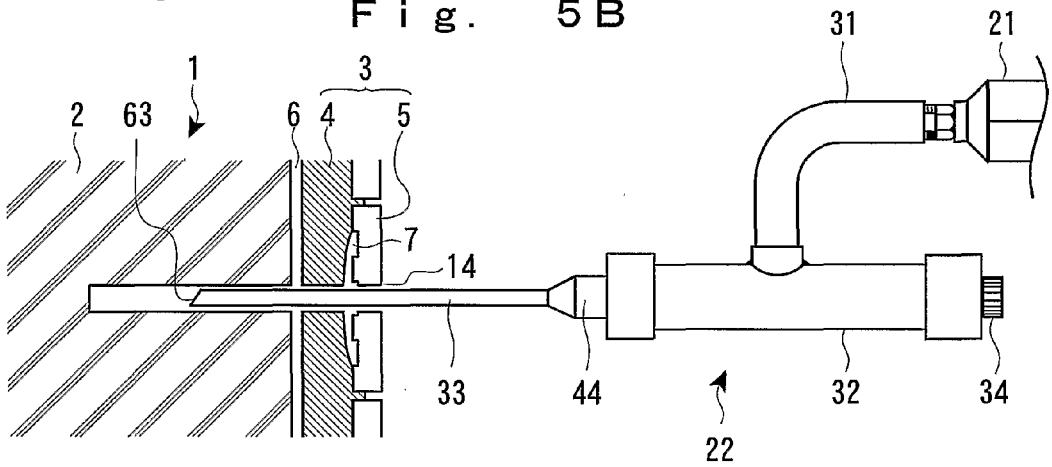
Figure 5C:
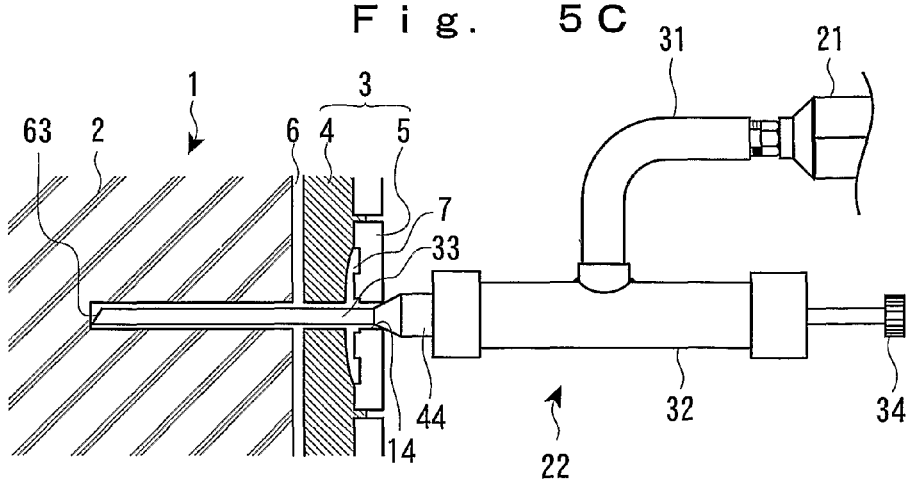
Figure 6A:
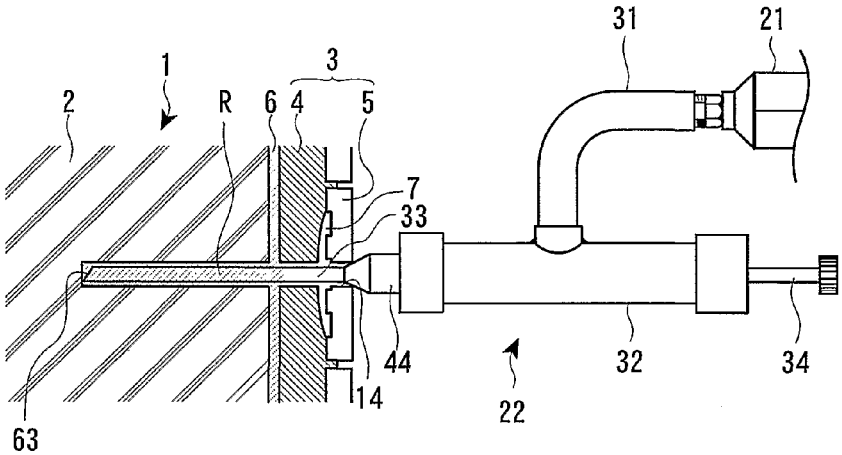
FIGS. 6A to 6C are procedural diagrams showing a third step of injecting an adhesive, a fourth step thereof, and a step of charging an anchor pin, respectively.
Figure 6B:
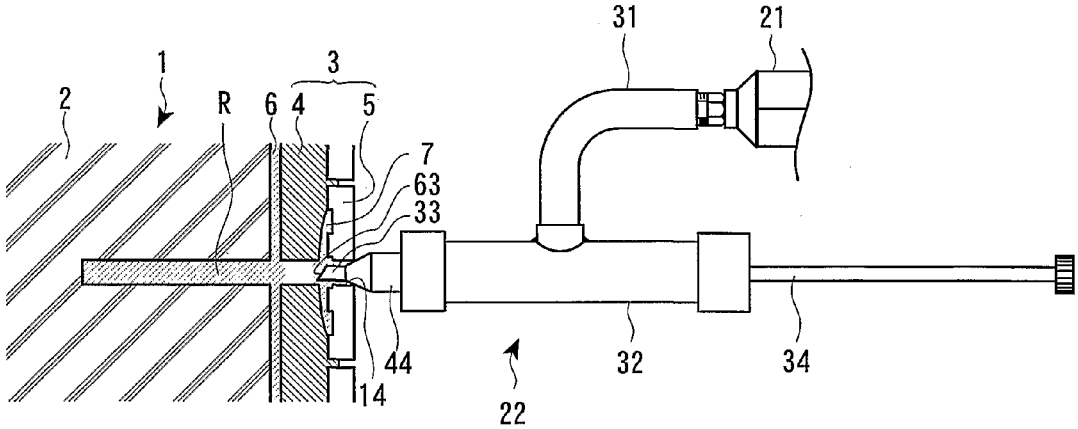
Figure 6C:
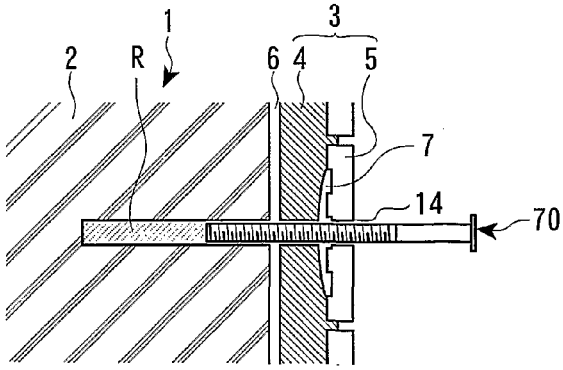

With reference to FIGS. 5A to 5C as well as FIGS. 6A to 6C, a description will be made about the pinning method according to the performing procedure, the pinning method being for performing repairs to the outer wall 1 by using the above-described adhesive injector 11. This pinning method is made up of: a hammering step of determining the boring position (separated portion) of the charging hole 8 by hammering the outer wall 1; a boring step of boring the charging hole 8 into the outer wall 1 of the boring position; an adhesive injection step of injecting the adhesive R into the charging hole 8 by using the adhesive injector 11; and a pin charging step of charging the charging hole 8 with the anchor pin 70, the charging hole 8 having been injected with the adhesive R.

In the hammering step, the outer wall 1 is hammered by using a hammer, and the like, to sound out the portions to be repaired on the outer wall 1, i.e., the first separated portion 6 between the concrete framework 2 and the mortar 4 as well as the second separated portion 7 between the mortar 4 and the decorative material 5, based on the hammering sound, thereby determining the boring positions of each charging hole 8. Subsequently, marking is appropriately made at the boring position (center position of each tile).

In the boring step, each charging hole 8 is bored at that boring position of the outer wall 1 which has been marked by using a boring tool 75 such as a diamond core drill. In other words, each hole is bored to a predetermined depth through the concrete framework 2 by penetrating through the decorative material 5 and the mortar 4, whereby the charging hole 8 is formed (see FIG. 5A). At this time, boring is made at right angles to the outer wall 1 and the boring depth into the concrete framework 2 shall be greater than or equal to 30 mm. In addition, the charging hole 8 is formed in a straight hole having a diameter which is slightly larger (1 mm to 2 mm larger in diameter) so as to allow for loose fitting of the anchor pin 70 thereinto. Since the cutting chips of the concrete framework 2, and the like, remain in the charging hole 8, the cutting chips, and the like, are thereafter removed by blowing with a blower, and the like, or by suction with a vacuum dust collector, and the like, thereby cleaning the charging hole 8. It is, of course, possible to omit this removing step in case the boring is made by using cooling water, whereby the cutting chips flow out together with the cooling water.

In the adhesive injection step, the advanced nozzle inner cylinder 33 is inserted into the charging hole 8 (see FIG. 5B), and the nozzle inner cylinder 33 is brought into contact with the bottom of the hole and also the sealing member 44 is brought into contact with the opening portion 14 of the charging hole 8, whereby the dimension of protrusion of the nozzle inner cylinder 33 is adjusted (see FIG. 5C). Then, in a state in which the opening portion 14 is kept sealed (or urged) by the tapered portion 52 of the sealing member 44, the lever 26 of the injector main body 21 is operated (pumped). The adhesive R is thus injected into the charging hole 8 (see FIG. 6A). Once the pumping is started, the adhesive R is discharged out of the adhesive discharge port 63, whereby the adhesive R is gradually injected from the deepest portion of the charging hole 8. The adhesive R soon flows into the first separated portion 6. Once the injection of resin into the first separated portion 6 is physically perceived due to the degree of load in pumping, the nozzle inner cylinder 33 is retracted so as to face the second separated portion 7. Pumping is again performed so that the adhesive R is sufficiently injected also into the second separated portion 7 (see FIG. 6B). Although there is sometimes formed air accumulation in an intermediate portion between the first separated portion 6 and the second separated portion 7, the trapped air will be vented due to the negative pressure which occurs at the time of pulling out the injection nozzle 22 out of the charging hole 8. Of course, the adhesive R may be injected in a plurality of steps while retracting the nozzle inner cylinder 33.

In the pin charging step, the charging hole 8 into which the adhesive R has been injected is charged with the anchor pin 70, while guiding the pin body portion 72 of the anchor pin 70. The anchor pin 70 is caused to be charged into the deepest portion of the charging hole 8 while pushing aside the adhesive R inside the charging hole 8. As a result, the adhesive R flows into the clearance so as to conform to the pin body portion 72 and is partly forced out toward the opening portion 14 of the charging hole 8. When the pin body portion 72 of the anchor pin 70 has reached the deepest portion of the charging hole 8, the pin head portion 71 will close the opening portion 14 (see FIG. 6C). In this case, if an arrangement is made such that the volume of non-filled portion which has not been filled with the adhesive R and which is generated after the nozzle inner cylinder 33 has been pulled out, and the volume of the anchor pin 70 are substantially equal to each other, the adhesive R will not leak out of the charging hole 8 when the anchor pin 70 is inserted into the charging hole 8 in the adhesive injection step. It is thus possible to substantially fill the charging hole 8 with the adhesive R without the possibility of flowing of the adhesive R out of the charging hole 8.

As described above, according to the injection nozzle 22 of this embodiment, in the injection work in which the adhesive R is injected while urging (sealing) the sealing member 44 of the nozzle outer cylinder 32 against the opening portion 14 of the charging hole 8, the nozzle inner cylinder 33 which discharges the adhesive R from its front end can be appropriately operated to move back and forth. Therefore, the adhesive R can be caused to be filled uniformly from the deepest portion (inner portion) of the charging hole 8 to the shallow portion thereof. Therefore, it is possible to cause the adhesive R to sufficiently flow into the first separated portion 6 and the second separated portion 7 (the adhesive R gets spread substantially circularly with the charging hole 8 serving as the center). As a result, the anchor pin 70 and the adhesive R can be effectively operated on the outer wall 1, whereby a complete repairing of the outer wall 1 is possible.

Figure 7:
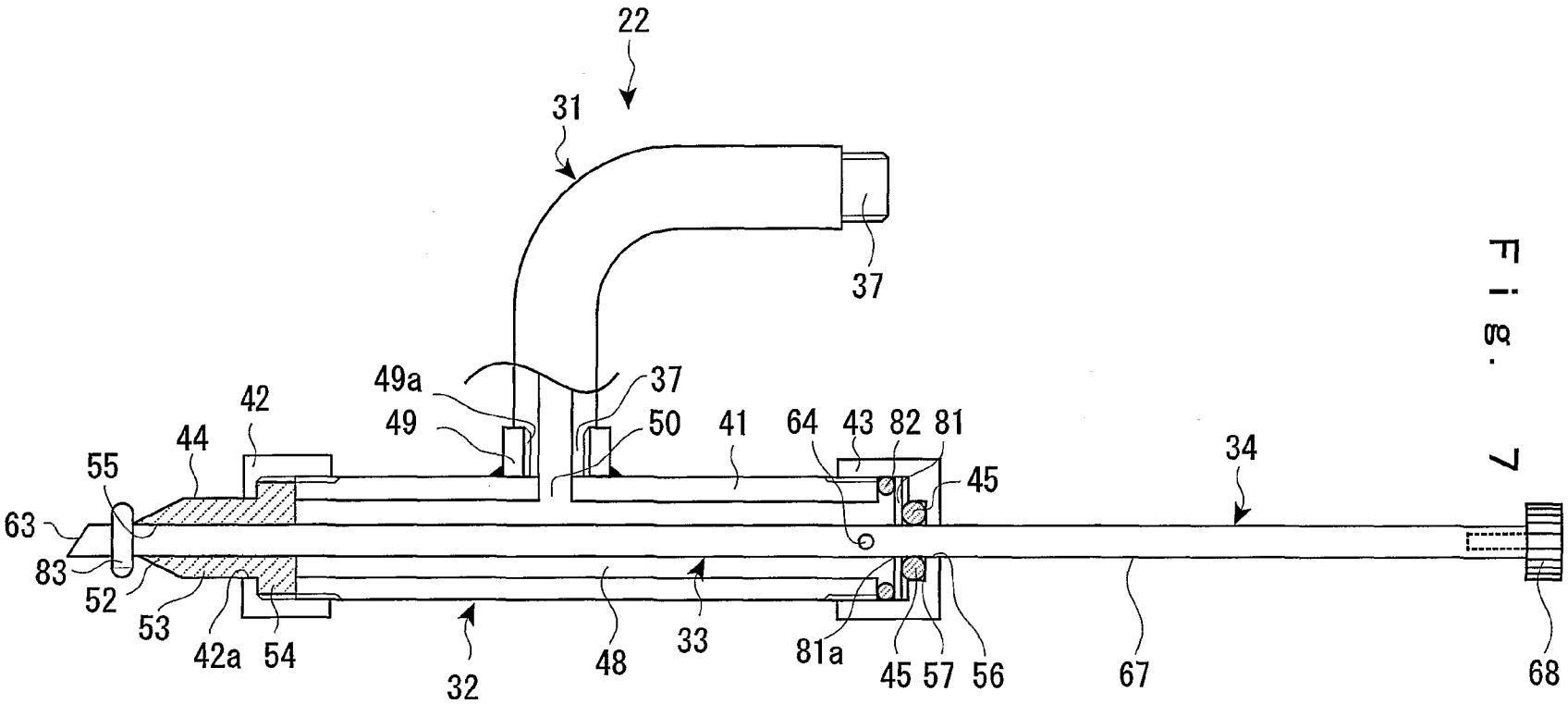
FIG. 7 is a sectional view of the injection nozzle relating to a second embodiment of this invention.

With reference to FIG. 7, a description will now be made about a second embodiment of the injection nozzle 22 of this invention. In this embodiment, the outer cylinder main body 41 is constituted simply of a bottomless cylindrical body, and there are interposed: a disc 81 which is the same in diameter as the inside diameter of the rear-end closing cap 43 (outside diameter of the nozzle outer cylindrical body 32); as well as a second O-ring 82. The disc 81 has formed therein a rod-penetrating hole 81*a* which is of the same diameter as the above-described rod-inserting hole 56. When the rear-end closing cap 43 is engaged in a threaded manner with the rear-end peripheral surface of the outer cylinder main body 41 in a state in which the above-described O-ring 45 and the second O-ring 82 are enclosed with the disc 81 being sandwiched therebetween, the clearance between the outer cylinder main body 41 and the rear-end closing cap 43 is sealed by means of the disc 81.

Further, at the front-end portion of the nozzle inner cylinder 33, there is provided a pressure-receiving flange 83 which receives the discharge pressure (injection pressure) of the adhesive R to be injected from the adhesive discharge port 63 into the charging hole 8. The pressure-receiving flange 83 is constituted of an O-ring which is fit onto the periphery of the nozzle inner cylinder 33, a collar portion fixed to the periphery of the nozzle inner cylinder 33, and the like, and the outside diameter thereof is formed to be slightly smaller than the diameter of the charging hole 8. In addition, the pressure-receiving flange 83 serves as a position stopper to restrict the receded position of the nozzle inner cylinder 33, whereby the above-described stopper block 62 is omitted.

When the injection of the adhesive R is started in a state in which the nozzle inner cylinder 33 is moved to the advanced position by means of the operation rod 34, the adhesive R gets filled into the charging hole 8 from the deepest portion toward the inlet side. At this time, the adhesive R reaches the position of the pressure-receiving flange 83 and functions to push the pressure-receiving flange 83 toward the opening portion 14. In other words, as the injection of the adhesive R progresses, the nozzle inner cylinder 33 gradually recedes by means of the pressure-receiving flange 83, and the adhesive R thus gets filled into the charging hole 8 from the deepest portion thereof. For example, in case the first separated portion 6 is wide and large, the receding of the nozzle inner cylinder 33 stops, despite the repeated pumping, when the pressure-receiving flange 83 of the nozzle inner cylinder 33 (adhesive discharge port 63) has reached the first separated portion 6. In such a case, the operation rod 34 causes the nozzle inner cylinder 33 to recede so that the adhesive discharge port 63 faces the second separated portion 7, thereby injecting the adhesive R into the second separated portion 7. However, in case the first separated portion 6 is small, the receding of the nozzle inner cylinder 33 continues and, as a result, the injection of the adhesive R into the second separated portion 7 becomes possible. The balance between the discharge pressure of the adhesive R and the timing to start the receding of the nozzle inner cylinder 33 is adjusted mainly by the sliding resistance of the nozzle inner cylinder 33 against the sealing member 44. This pressure-receiving flange 83 can also serve as the operation member of this invention. In such an arrangement, the above-described operation rod 34 is not required.

Figure 8:
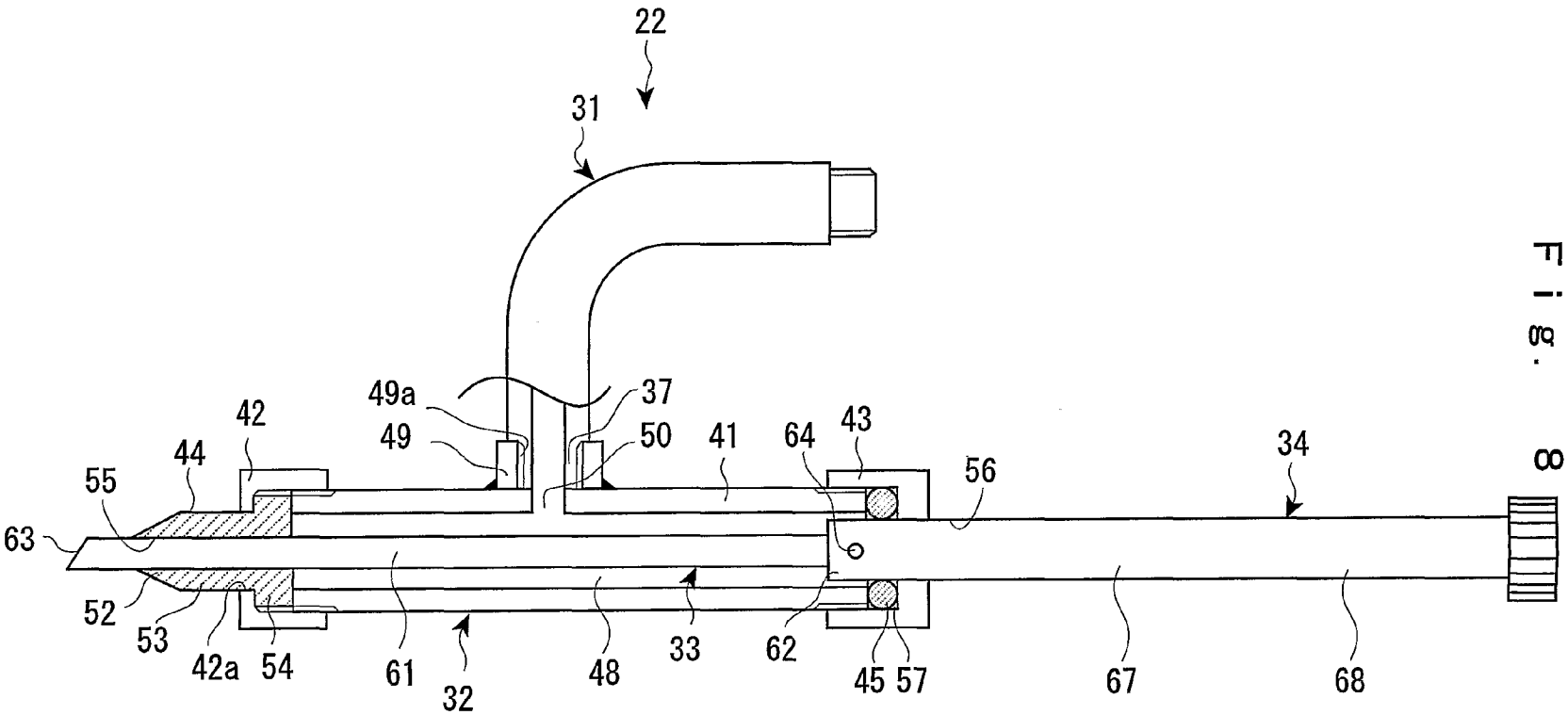
FIG. 8 is a sectional view of the injection nozzle relating to a third embodiment of this invention.

With reference to FIG. 8, a description will now be made about a third embodiment of the injection nozzle 22 of this invention. In this embodiment, the outer cylinder main body 41 is made of a bottomless cylindrical body, and the operation rod 34 is formed to be larger in diameter than the above-described examples. Further, the above-described communication opening 64 is penetrated at a front-end portion (portion to be connected with the nozzle inner cylinder) of the operation rod 34. The rear end of the outer cylinder main body 41 is arranged to come into contact with the O-ring 45 through which the operation rod 34 is inserted. In this case, too, when the rear-end closing cap 43 containing therein the O-ring 45 is screwed onto the periphery of the rear-end portion of the outer cylinder main body 41, the O-ring 45 comes into close contact with the rear end of the outer cylinder main body 41 and with the sliding operation rod 34.

In addition, as described above, the operation rod 34 is formed to be larger in diameter than the diameter of the nozzle inner cylinder 33. According to this arrangement, when the injection of the adhesive R is started from the deep portion of the charging hole 8 in a state in which the nozzle inner cylinder 33 is advanced, the internal pressure in the intermediate passage 48 becomes higher with the progress of the injection. At this time, the internal pressure of the intermediate passage 48 strongly acts on the end surface of the operation rod 34, thereby causing the nozzle inner cylinder 33 to gradually recede by means of the operation rod 34. In other words, the nozzle inner cylinder 33 can automatically recede without operating the operation rod 34 to recede. As a result, the adhesive R can be sufficiently injected over a range from the deep portion to the shallow portion of the charging hole 8. In this case, too, the balance between the internal pressure of the intermediate passage 48 and the timing to start the receding of the nozzle inner cylinder 33 is adjusted by the sliding resistance of the operation rod 34 against the O-ring 45, or by this sliding resistance and the sliding resistance against the sealing member 44, as well as by the diameter of the operation rod 34.

Figure 9A:
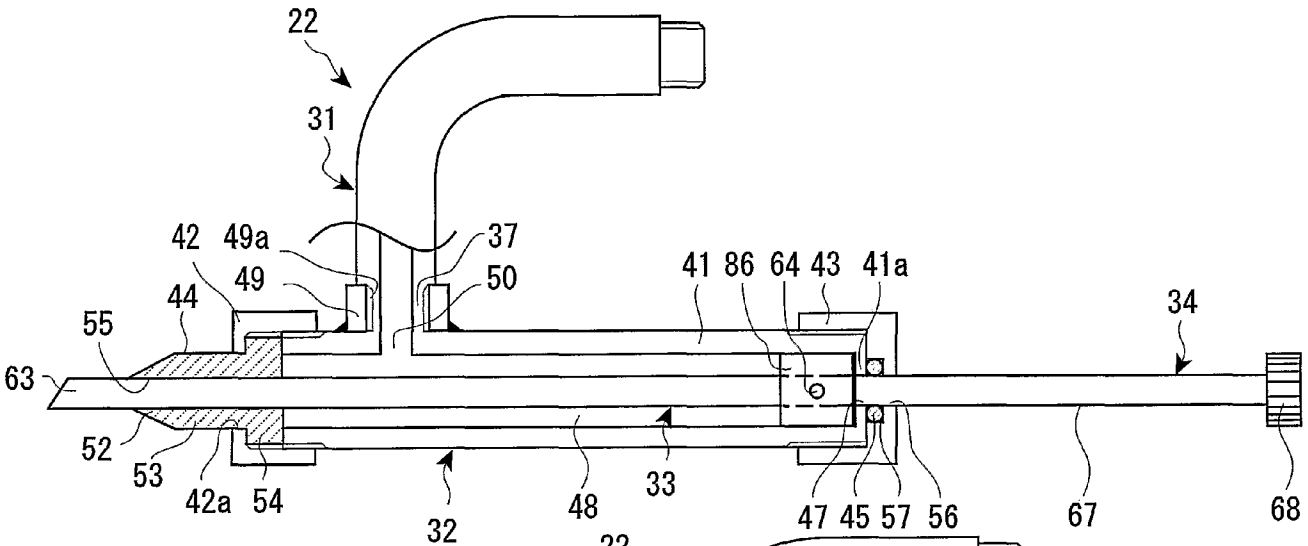
FIGS. 9A and 9B are sectional views of the injection nozzle relating to a fourth embodiment of this invention.
Figure 9B:
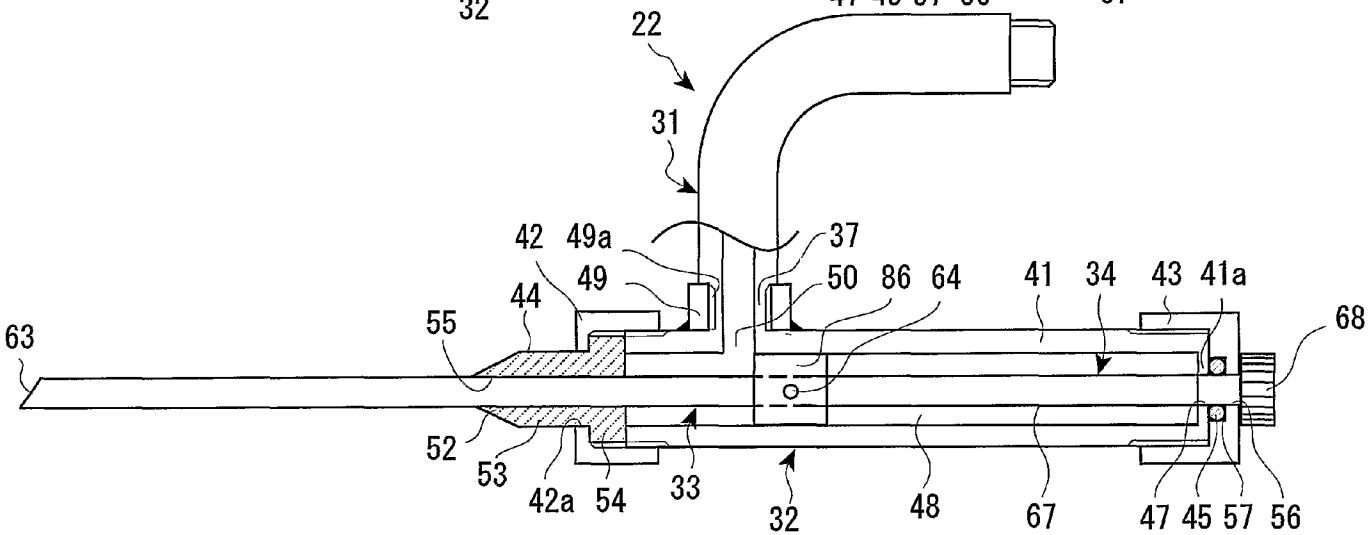

With reference to FIGS. 9A and 9B, a description will now be made about an injection nozzle 22 according to a fourth embodiment of this invention. In the injection nozzle 22 of this embodiment, the connection arm 31 is connected to the front-end side of the nozzle outer cylinder 32. The nozzle inner cylinder 33 has fixed thereto, in place of the stopper block 62, a piston block 86 (piston portion) which is in sliding contact with the inner surface of the nozzle outer cylinder 32. Further, a communication opening 64 is formed near the front of the piston block 86. In this case, it is so arranged that the piston block 86 recedes upon receipt of the internal pressure in the intermediate passage 48 of the nozzle outer cylinder 32. In a state in which the nozzle inner cylinder 33 has moved to the advanced position (in which the operation knob 68 is in contact with the rear-end closing cap 43), the piston block 86 is positioned close to this side (near side) of the passage opening 50 (see FIG. 9B) and, in a state in which it has moved to the receded position, the piston block 86 is in contact with the bottomed portion 41*a* of the nozzle outer cylinder 32 (see FIG. 9A).

When the injection of the adhesive R is started from the deep portion of the charging hole 8 in a state in which the nozzle inner cylinder 33 is advanced, the internal pressure in the intermediate passage 48 becomes high with the progress of the injection. When the internal pressure in the intermediate passage 48 becomes higher, this internal pressure acts on the piston block 86 and causes the nozzle inner cylinder 33 to gradually recede by means of the piston block 86. Namely, without the necessity of operating to recede the operation rod 34, the nozzle inner cylinder 33 can automatically recede, whereby the adhesive R can be sufficiently injected to the portion over a range from the deep portion to the shallow portion of the charging hole 8. It may alternatively be so arranged that the adhesive passage 36 of the connection arm 31 is branched for connection to the front and rear of the piston block 86 (to thereby form a double acting piston), whereby the advancing of the nozzle inner cylinder 33 is also automatically performed by switching of a valve.

The invention claimed is:

1. An adhesive injector made up of an injection nozzle and an injector main body for use in a pinning method, the injection nozzle being adapted to be mounted on the injector main body while in use, the pinning method being performed by injecting an adhesive into a charging hole bored into a framework to a predetermined depth through a finishing material, the injection of the adhesive being made while sealing an opening portion of the charging hole, the injection nozzle comprising:

a connection arm mounted on the injector main body and having an adhesive passage in communication with the injector main body;

a nozzle outer cylinder supported by the connection arm and having therein an intermediate passage in communication with the adhesive passage, the nozzle outer cylinder also having at a front end thereof a sealing member for sealing the opening portion;

a nozzle inner cylinder elongating through the sealing member and being slidably supported inside the nozzle outer cylinder, the nozzle inner cylinder having (1) an injection passage communicating with the intermediate passage through a communication opening, the injection passage formed at a rear end portion of the nozzle inner cylinder and, (2) at a front end portion of the nozzle inner cylinder, an adhesive discharge port communicating with the injection passage;

a reinforcing member fixed to fit on the rear end portion of the nozzle inner cylinder, the reinforcing member being internal to the nozzle outer cylinder; and an operation member capable of moving the nozzle inner cylinder at any position between an advanced position where the adhesive discharge port lies deep inside the charging hole and a receded position where the adhesive discharge port lies shallow inside the charging hole, wherein the communication opening is formed so as to pass through peripheral surfaces of the reinforcing member and the inner cylinder main body at the rear end portion of the nozzle inner cylinder, the operation member is connected to the rear end portion of the nozzle inner cylinder, the operation member being a rod-shaped member elongating through a rear end portion of the nozzle outer cylinder, and under the condition that the adhesive is injected into the charging hole, the adhesive passage, the intermediate passage and the injection passage are configured to always be in communication with one another.

2. The adhesive injector made up of the injector nozzle and the injector main body according to claim 1, wherein the nozzle inner cylinder and the operation member are constituted of an integral pipe.

3. The adhesive injector made up of the injector nozzle and the injector main body according to claim 1, wherein the operation member is formed to have a diameter larger than that of the nozzle inner cylinder.

4. The adhesive injector made up of the injector nozzle and the injector main body according to claim 1, further comprising at the front end of the nozzle inner cylinder a pressure-receiving flange for receiving a discharge pressure of the adhesive injected from the adhesive discharge port into the charging hole.

5. The adhesive injector made up of the injector nozzle and the injector main body according to claim 1, wherein the reinforcing member serves as a stopper for restricting the receded position of the nozzle inner cylinder.

6. The adhesive injector made up of the injector nozzle and the injector main body according to claim 1, wherein the nozzle outer cylinder comprises:

an outer cylinder main body of cylindrical shape;

a front-end closing cap for closing the front end of the outer cylinder main body of a cylindrical shape; and a rear-end closing cap for closing the rear end of the outer cylinder main body, the rear-end closing cap being of a cylindrical shape, wherein the front-end closing cap is coupled to the outer cylinder main body of a cylindrical shape in a state of sandwiching a base portion of the sealing member between the cap and the outer cylinder main body of a cylindrical shape.

7. The adhesive injector made up of the injector nozzle and the injector main body according to claim 1, wherein the rear-end portion of the nozzle inner cylinder is provided with a piston portion which comes into sliding contact with an inner circumference of the nozzle outer cylinder.

8. The adhesive injector made up of the injector nozzle and the injector main body according to claim 1, wherein the adhesive exits the nozzle inner cylinder in a same direction as its central axis.

* * * * *